US005842296A

United States Patent [19]

Liu

[11] Patent Number: 5,842,296

[45] Date of Patent: Dec. 1, 1998

[54] CRYSTAL BALL WITH ASSEMBLED MOTIVE DIE SET

[76] Inventor: Jack Liu, No. 3, Alley 202, Kao-Fon Rd., Hsin-Chu City, Taiwan

[21] Appl. No.: 611,668

[22] Filed: Mar. 6, 1996

[51] Int. Cl.[6] ..... G09F 19/08

[52] U.S. Cl. ..... 40/411; 40/409; 74/54

[58] Field of Search ..... 40/406, 409, 410, 40/411, 414; 446/297; 84/94.1, 94.2, 95.1, 95.2; 74/54

[56] References Cited

U.S. PATENT DOCUMENTS

| | | | |
|---|---|---|---|
| 4,983,890 | 1/1991 | Satoh et al. | 40/414 X |
| 5,134,795 | 8/1992 | Wang | 40/411 |
| 5,339,923 | 8/1994 | Chen | 40/411 X |
| 5,412,890 | 5/1995 | Fechter | 40/414 |
| 5,458,012 | 10/1995 | Liu | 40/409 X |
| 5,459,278 | 10/1995 | Hsu | 84/95.1 |
| 5,584,742 | 12/1996 | Chen | 84/94.2 X |

*Primary Examiner*—Brian K. Green
*Attorney, Agent, or Firm*—Beveridge, DeGrandi, Weilacher & Young LLP

[57] ABSTRACT

A crystal ball having an assembled motive die set. The crystal ball includes a music box and a driving base, wherein the driving base has a plurality of driven gears which are driven by the center motive gear installed on the base of the driving substrate. Assembled motive die sets representing different motion types are mounted on the upper cover of the base with respect to the driven gears, and are changeable as desired. The motive die set is influenced by the dynamic force of the music box through the driving base.

12 Claims, 9 Drawing Sheets

CRYSTAL BALL WITH ASSEMBLED MOTIVE DIE SET

BACKGROUND OF THE PRESENT INVENTION

The present invention is related to a crystal ball with assembled motive die set, and especially, to a motive die set the elements of which can be assembled and changed as desired so that the interior of the crystal is presented with various dynamic phenomena.

DESCRIPTION OF THE PRIOR ART

The driving device of the crystal ball decorative article with dynamic phenomena of the prior art is basically to drive an interior structure of the crystal ball which is driven to present dynamic phenomenon.

For a further detailed design related to a crystal ball, the driving device drives at least two dynamic structures so that the crystal ball is plentiful of dynamic phenomena.

However, the components of said crystal ball structure are designed for specific dynamic phenomena, thus the components of different types of the crystal ball decorative articles are not adaptive to each other. Therefore, the costs of die sets, stock and management are increased.

SUMMARY OF THE INVENTION

Accordingly, the object of the present invention is to provide a crystal ball with assembled motive die set. A plurality of assembled motive die sets for present various dynamic phenomena are provided on the base and the positions for different motive die sets are changeable so that a plurality of components of the crystal ball especially the driving substrate, are adaptive to each other. Such an arrangement is more convenient in regard to the assembly of the die set, stock, and management and also is more cheaper in cost than that of the prior art.

Moreover, because the driving means of the present invention may be assembled with a plurality of motive die set, the volume of said crystal ball is probable bigger and heavier. When the spring of the music box is wound, the assembled orientation of the music box needs to be changed, so the a steering means is installed for the user to wind the spring from the side of the crystal ball.

DESCRIPTION OF THE PREFERRED EMBODIMENT

Figure 1:
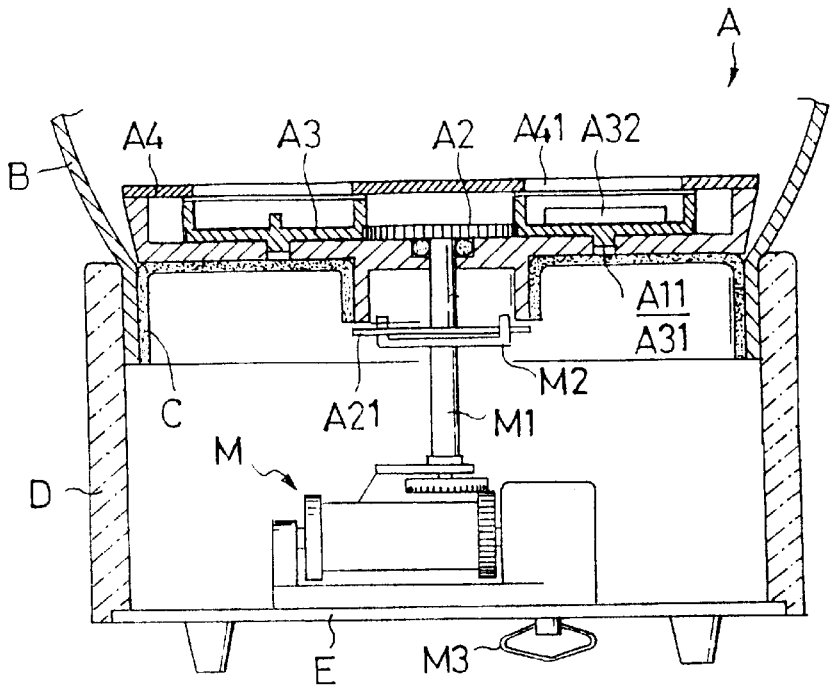
FIG. 1 is a view of the crystal ball which shows the assembled relation of the driving substrate with respect to a rubber stopper, a glass ball and a music box.

The structure of the crystal ball of the present invention contains a driving box (A) which is supported and located on the upper surface of the rubber stopper (C) below the glass ball (B) as shown in FIG. 1. Moreover, a music box is installed on the bottom base (E) below and wood base (D), the power is output from the music box through the longitudinal output axle (M1) and an elastic claw (M2).

Figure 3:
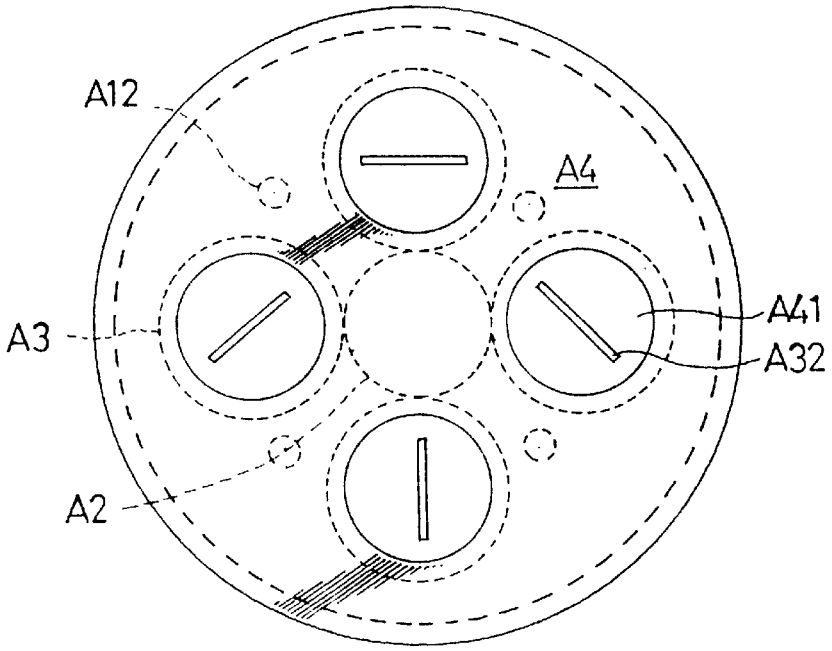
FIG. 3 is the top view of the FIG. 2.
Figure 2:
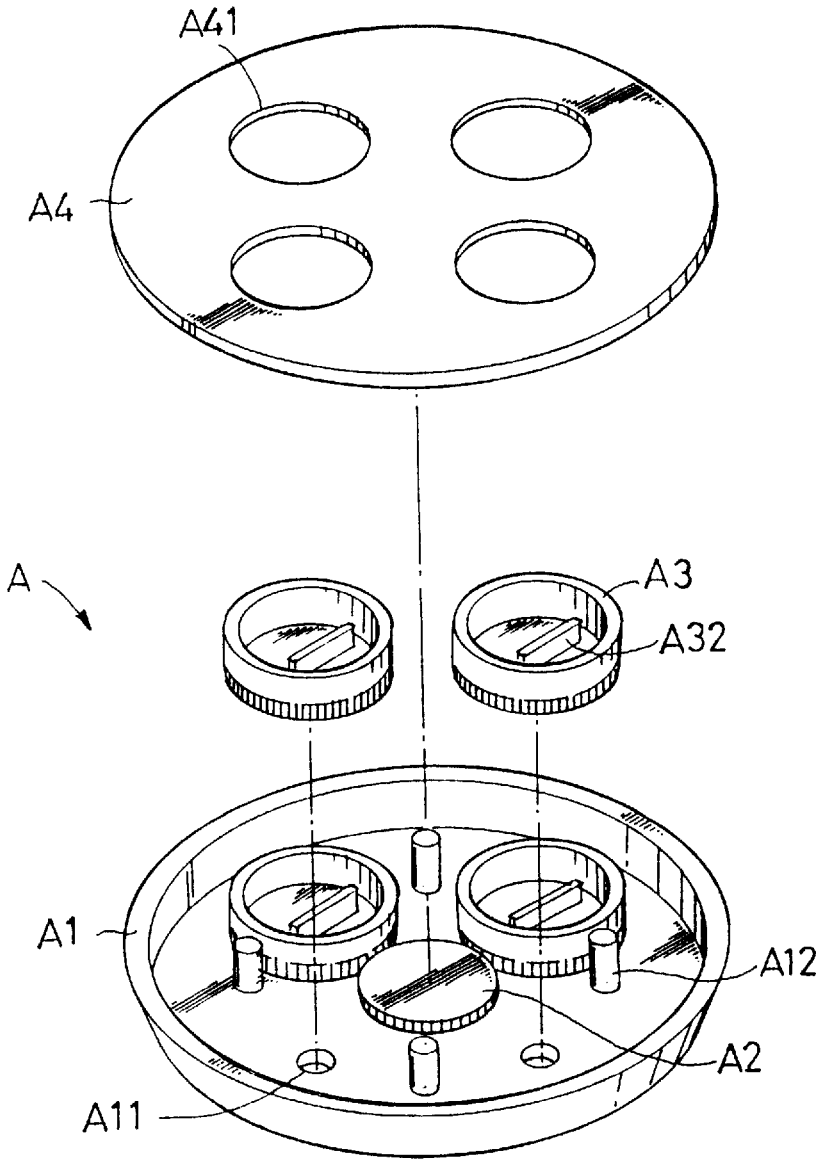
FIG. 2 is the cubic view of the driving substract of the FIG. 1.

As shown in the FIGS. 2 and 3, said driving substrate of the crystal ball according to the present invention comprises a disk shape base (A1) on the center of which a motive gear (A2) is mounted and about the periphery of which a plurality of disk shaped driven gears are mounted with equal spacing and engaged therewith. The driven gear (A3) forms a convex axle (A31) which is engaged with an axle hole (A11) defined in the base so that when the motive gear (A1) is driven to rotate by the driven connection link (A21) and the center axle (A22), the driven gear is driven to rotate about the convex axle (A31).

Moreover, a cross separation sheet (A32) is mounted on the proper height through the center of the driven gear (A3).

Further, a top cover (A4) is installed above the bottom base (A1) against the supporting column of the bottom base (A1), and said supporting column is positioned between the adjacent driven gears (A3). A round hole smaller than the inner radius of the driven gears (A3) is formed in the top cover (A4) and positioned with respect to the driven gears (A3).

Figure 4:
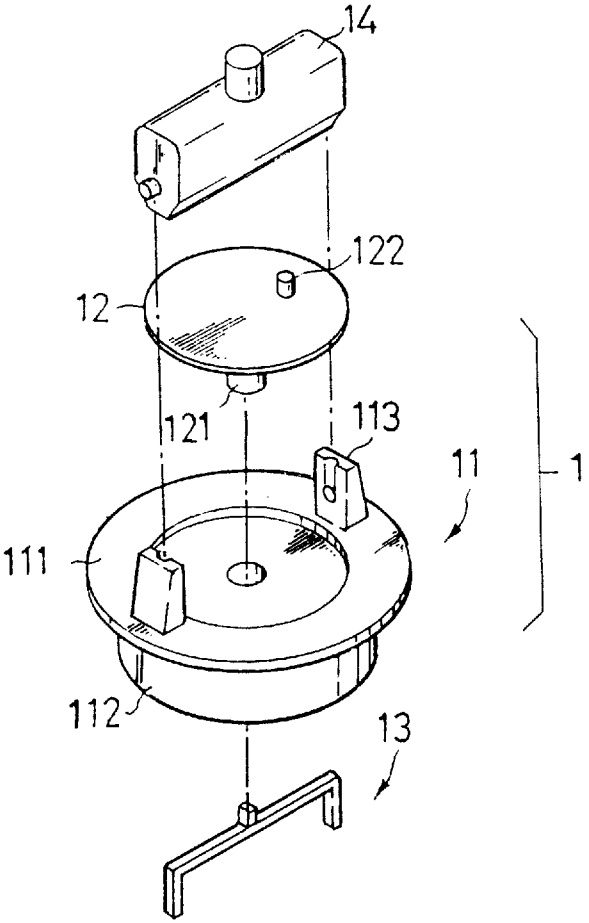
FIG. 4 is the perspective view of the motive die set attaching in the driving substrate.

As shown in the FIG. 4, a assembled motive die set (1) comprises a assembled body (11) having a disk surface (111) the diameter of which is larger then the disk surface the top cover round hole (A41) of the base. The lower part of the body (11) forms a neck part (112), the outer diameter of which is equal to that of the top cover round hole (A41) of the base. Therefore, said body (11) is secured on the top cover (A4) through the tightly engagement of the neck part (112) and the top cover round hole (A41).

Besides, a rotary disk (12) is installed above the disk surface (111). The axle (121) of said rotary disk (12) is connected with an elastic claw (13) located on the body neck (112) in order that the rotary disk (12) is driven through the elastic claw (13). Meanwhile, the surface of said rotary disk (12) is installed with a offset pin (122).

A vibrating block (14) is installed above the rotary disk (12) and is retained with a proper distance therewith. The vibrating block (14) is pivotally connected with the supporting wall (113) on the periphery of the disk surface (111), and a long recess (141) is formed under the vibrating block (14) in order to contain said pin (122).

Figure 5:
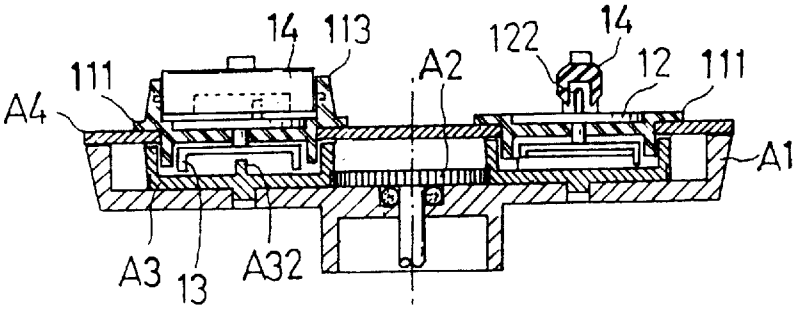
FIG. 5 is the front section view of the motive die set attaching in the driving substrate of the FIG. 4.

As shown in FIG. 5, in the assembled motive die set (1), when the neck part (112) is installed on the top cover round hole (A41), the horizontal height of the end part of the elastic claw (13) is within the rotary range of the cross separation sheet (A32) within the driven gear (A3).

Figure 6:
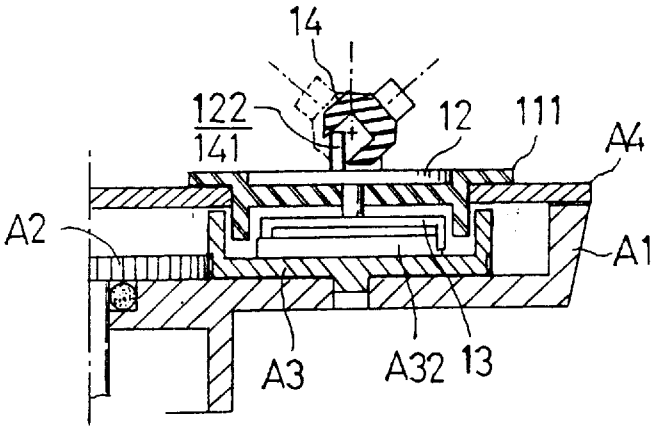
FIG. 6 is a schematic view which present the longitudinal repeated vibration of a driven motive die set.

The rotation of the elastic claw, i.e., the rotation of the rotary disk of the motive die set, will induce the offset pin (122) of the rotary disk (12) to drive the vibrating block (14) to vibrate, as shown in FIG. 6. If a doll is installed above the vibrating block (14), it will present a dynamic phenomenon of vibrating.

If the structure of the said motive die set (1) is simplified and a doll is fixed on the rotary center of the rotary disk (12), the doll will rotate on the original place.

According to the arrangement of said driving substrate (A) and different motive die sets (1), the position of each of the motive die sets (1) on the driving substrate can be changed as desired. Apparently, the motive die set (1) is formed as a type of being conveniently assembled.

Figure 7:
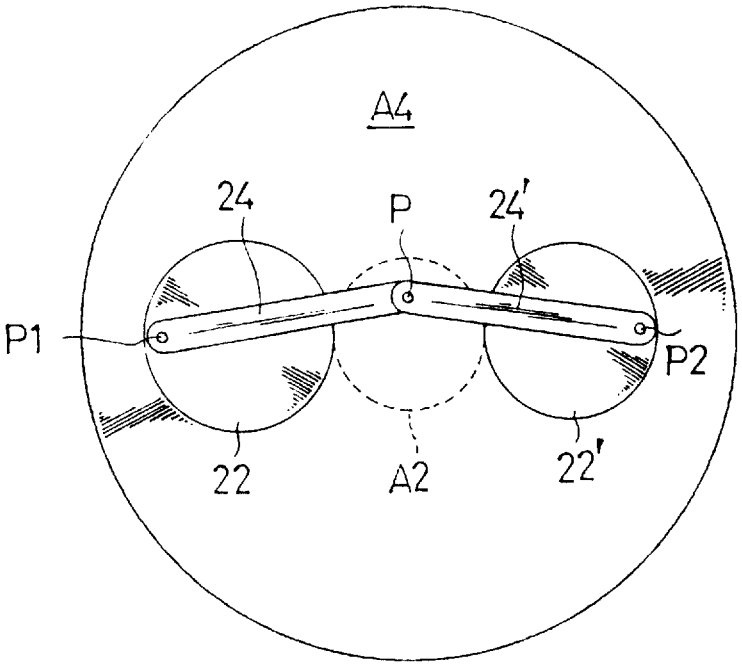
FIG. 7 is the top view for the assembly of a die set on the driving substrate.
Figure 8:
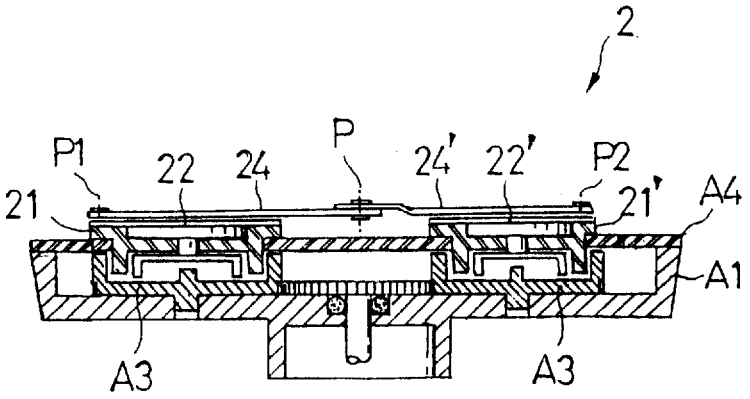
FIG. 8 is the front sectional view of FIG. 7.

The single motive die set (1) described above presents an independently dynamic phenomenon than that shown in FIGS. 7 and 8. The combined motive die set (2) comprises two sets of assembled bodies (21, 21') and two connection links (24, 24') above the rotary disks (22, 22'), wherein the corresponding ends of the two connection links (24, 24') are pivotally connected with the periphery of the rotary disk (22, 22') at the connecting points (P1, P2), and the adjoined ends of the two connection links (24, 24') is pivotally connected at the connecting point (P).

Said connecting points (P1, P2) may be installed on the non symmetric positions of the rotary disk, for example, a farther opposing end or a near opposing end, as shown in FIG. 7. Therefore, when the motive gear (A2) drives the driven gears (A3) for the rotary disks (22, 22') to rotate in the same orientation, the angle between the connection links (24, 24') will also change, i.e. the position of the connection point (P) is changed, as shown in the FIG. 9. If a doll is installed on the point (P), then it will present a specific dynamic phenomena.

Figure 9:
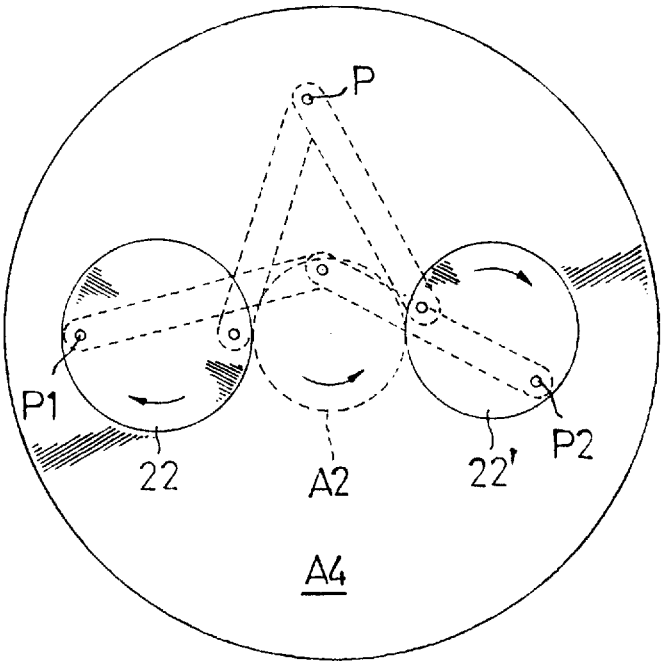
FIG. 9 shows the dynamic state of the driven connection link of the motive die set.

If the two driven gears (A3, A3') for rotating the rotary disks (22, 22') have the same diameters, the motions of said two connection links (24, 24') are regular, on the other hand, if the two driven gears (A3, A3') have different diameters, the positions of the connection point (P) of the connection links (24, 24') may have various irregular states, as shown in the FIG. 9.

Figure 10:
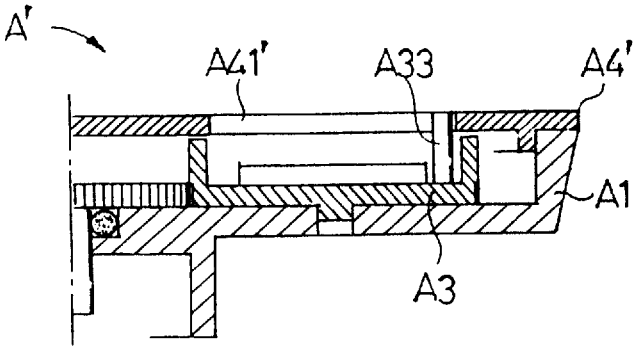
FIG. 10 is a modified embodiment of a driving substrate.
Figure 11:
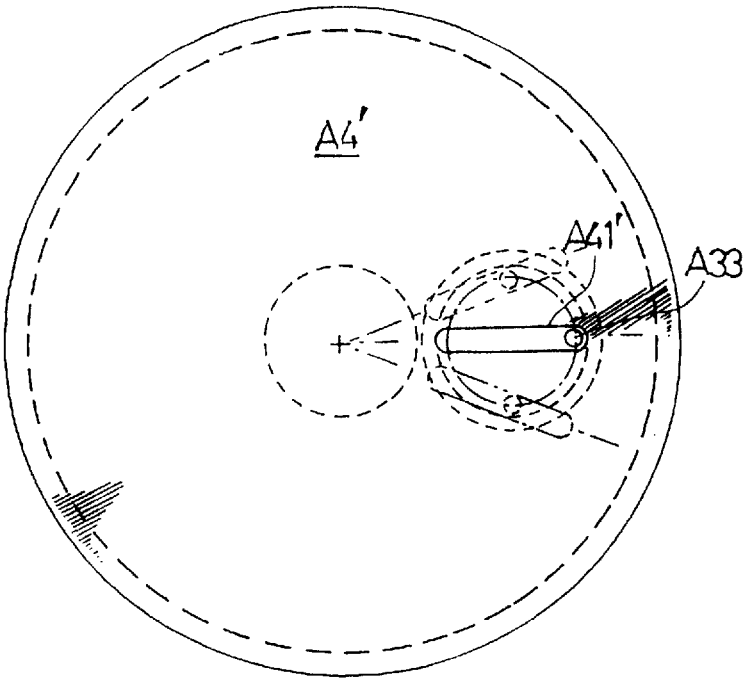
FIG. 11 is the top view of FIG. 10, it represent a axial repeated motion of a driven top cover of the driving substrate.

The upper cover of said driving substrate (A4) having motive die set (1) is stationarily fixed above the base (A1), and presents dynamic phenomena which is different from that of said motive die set (1). Shown in the FIGS. 10 and 11 is another structure of driving substrate (A'), basically the driving substrate (A') only have a driven gear (A3) engaging with the center motive gear (A2). The offset position of the driven gear (A3) is installed with a longitudinal column (A33) and the upper cover (A4') with respect to the base (A1) is in the state of freely rotating. A radial long hole (A41') installed on the upper cover (A4') with respect to the inner diameter of the driven gear (A3). Said longitudinal column (A33) is penetrated through the long hole (A41').

According to the structure of said driving substrate (A'), when the driven gear (A3) is similarly driven to rotate, the longitudinal column (A33) on the upper cover long hole (A41') will drive the upper cover (A4') through the long hole (A41') so to present a repeated vibration of the rotary diameter of the longitudinal column (A33). If a doll is installed above the upper surface of the upper cover (A4'), it may present various different dynamic phenomena which are different from said motive die set (1).

Figure 12:
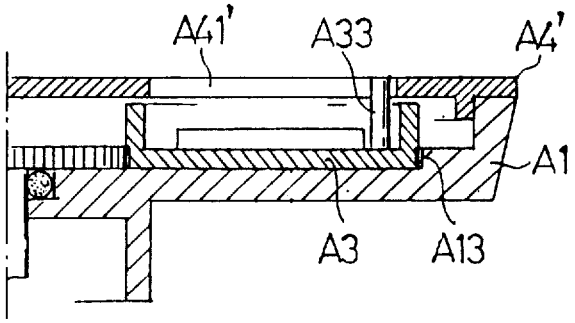
FIG. 12 is a modified embodiment of the FIG. 10.

The driven gear (A3) of said structure is in the state of revolution, if the inner periphery of the base (A1) is installed with a circular toothed strip (A13) engaged with the driven gear (A3), as shown in FIG. 12, then said driven gear (A3) presents a state of revolution and spin with respect to said upper cover (A4') according to the functions of the motive gear (A2) and the circular gear (A12) and also rotates according to the trace of the motion of the longitudinal column (A33).

Figure 13:
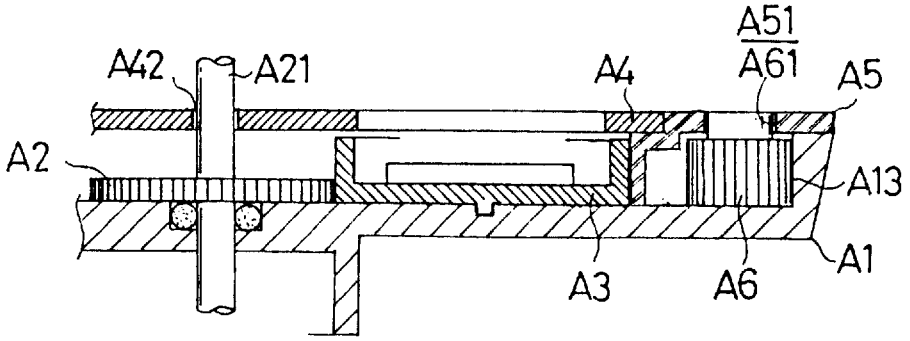
FIG. 13 is another modified embodiment of the FIG. 1.

In order that the present invention is plentiful of dynamic phenomena, as shown in the FIG. 13, a circular rotary cover is installed between the external of the upper cover (A4) and the outer rim of the bottom base (A1). The inner rim of the rotary cover (A5) is engaged with the driven gears (A3), so that the rotary cover (A5) is driven by the driven gears (A3). Furthermore, since a gear which is engaged with circular rack (A13) on the inner side wall of the bottom base (A1), so that a convex column (A61) is projected from a round hole (A51) of the rotary cover (A5), therefore the gears (A6) form a revolution condition due to the rotation of the rotary cover (A5) through the convex column (A61), and since the gear (A6) is engaged with the circular gears (A13) so the gear (A6) presents a dynamic phenomenon of spin, that is to say, the doll installed on the convex column (A61) presents the dynamic phenomenon of spin and revolution.

Moreover, a rotary axle (A21) through the penetrated hole (A42) of the upper cover is extended in the longitudinal direction from the upper side of the centered gear (A2), therefore when the centered gear (A2) is rotated, the doll on the rotary axle (A21) present a dynamic phenomenon with synchronous rotation.

Figure 14:
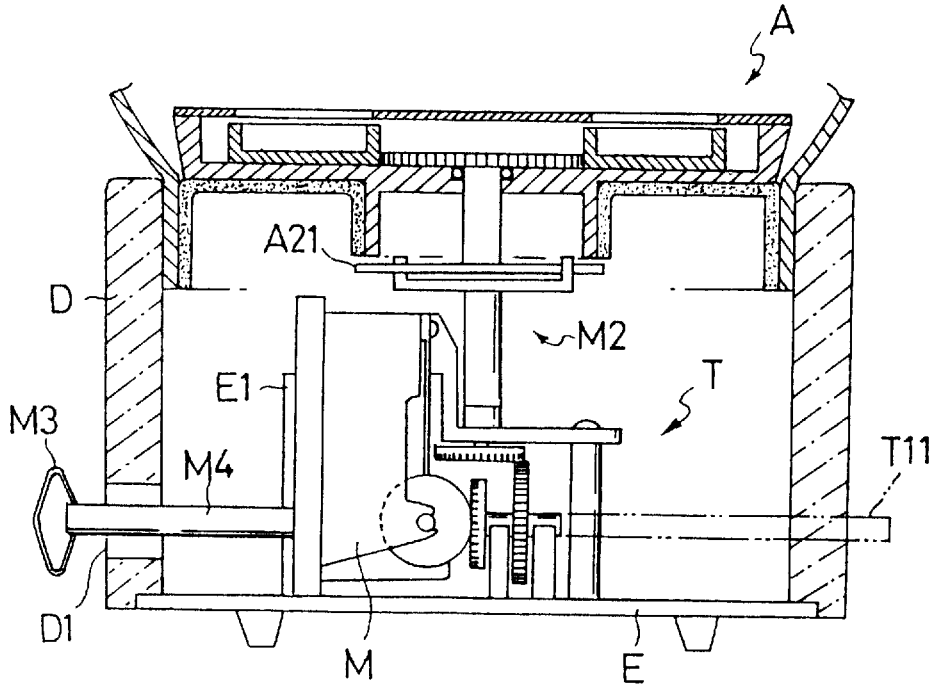
FIG. 14 is a modified embodiment of the power output of the music box, which represent the right cubic view of the position relation between the longitudinal music box and the steering means.

The music box (M) on the bottom base (E) is located transversely as shown in the FIG. 1, therefore the rotary button (M3) for winding the spring is formed below the bottom base (E). The crystal ball needs to be lifted upward as a whole for operating the rotary button (M3). In order to improve the defect of such designs, said music box (M) is installed longitudinal, thus the rotary button (N3) is located beside the wood base (D), therefore it is needless to lift the crystal ball for operating the button (M3) as shown in the FIG. 14.

Figure 15:
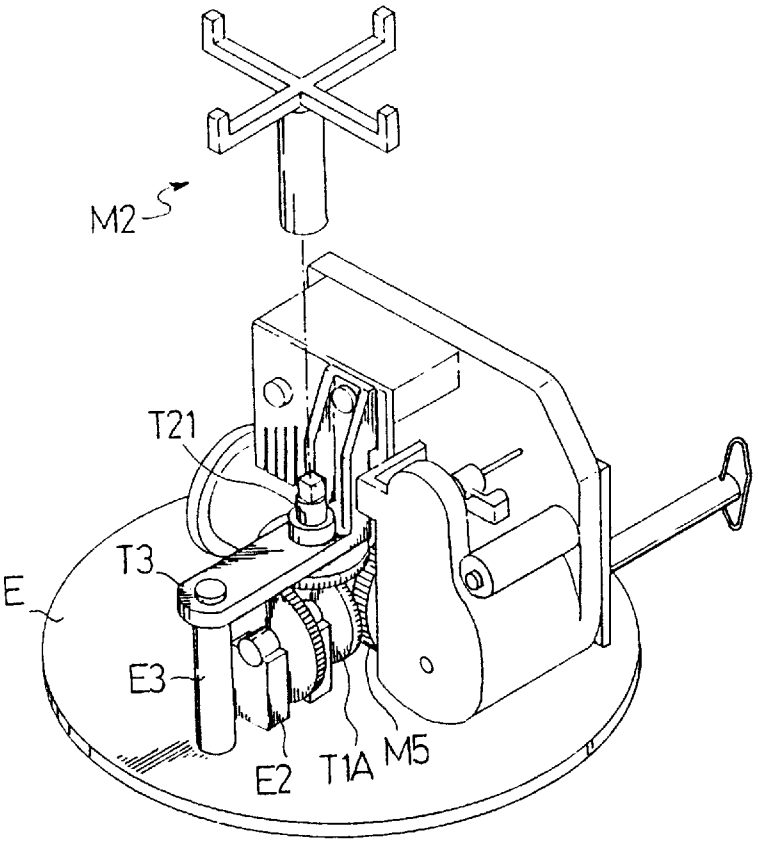
FIG. 15 is the cubic view of FIG. 14.
Figure 16:
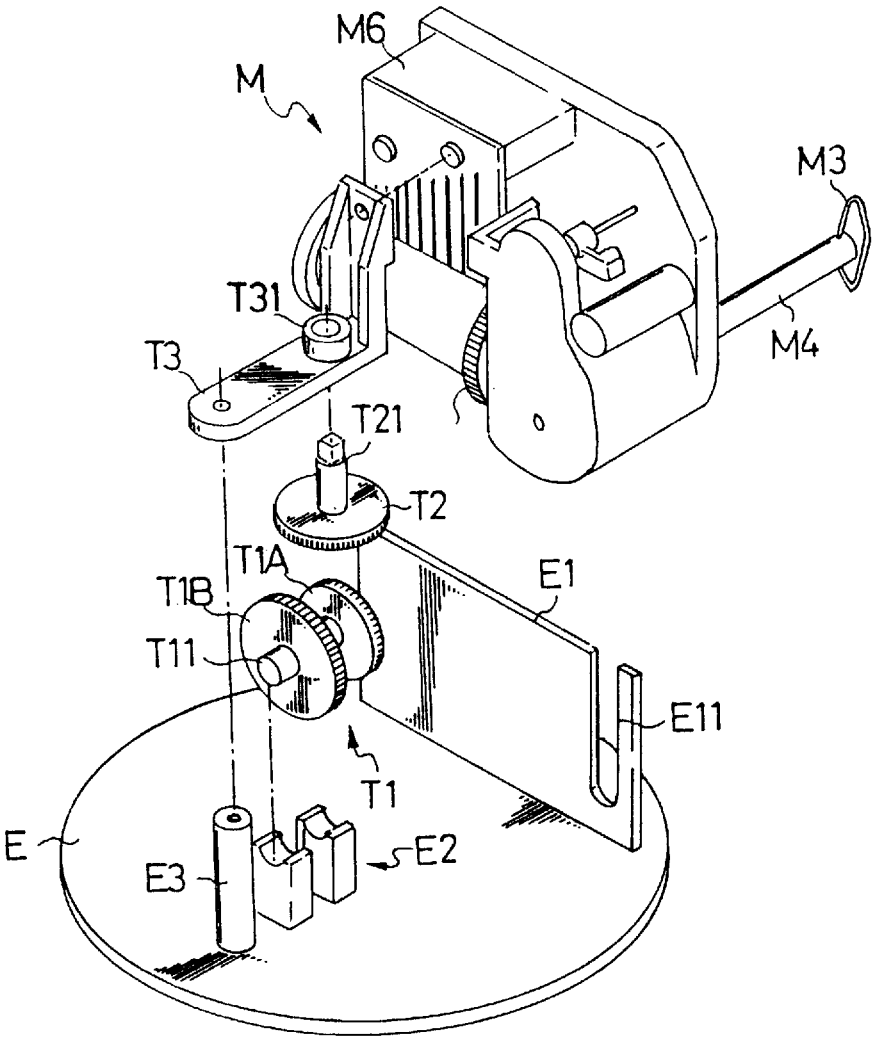
FIG. 16 the cross sectional view of the left side of the crystal ball adaptive for the music box of FIG. 14 and the steering means.

For fixing said music box (M) in the longitudinal direction, a longitudinal supporting board (E1) is installed on the bottom base (E) for fixing the music box (M), as shown in FIGS. 15 and 16. A notch (E11) is formed on the supporting board (E1) with respect to the spring axle (M4) of the music box (M). When the music box (M) is assembled in the supporting board (E1) for positioning, said spring axle (M4) can be extended horizontally through the penetrating hole (D1) of the wood base (D) so to projected to the outside of the wood base (D).

In order that the power of said music box (M) is transmitted to said driving base (A), a steering means (T) is installed on the side face of the music box (M) above the bottom base (E). Said steering means (T) contains a pair of longitudinal gears (T1A, T1B), the axle center (T11) of which is supported by the frame (E2) of the bottom base (E), wherein the longitudinal gear (T1A) is engaged with the gears (M5) of the music box (M).

Besides, a crown gear (T2) which is supported by the axle housing (T31) of a frame (T3) is installed above the longitudinal gears (T1A, T1B) and the crown gear (t2) is engaged with the longitudinal gear (T1B). Therefore, when the longitudinal gear (T1B) is driven to rotate by the gear (M5) of the music box (M), the crown gear is also rotated synchronously. The frame (T3) for supporting the crown gear (T2) has the shape of L, one side of which is fixed on the side face the base (M6) of the music base (M), and the other side is fixed on the supporting column (E3) of the bottom base (E).

As shown in the figures, an elastic claw (M2) can be engaged on the upper end of the wheel axle (T21) of the steering means (T2), and the motive gear (A2) is driven to rotated by the elastic claw (M2) through the driving lever.

Figure 17:
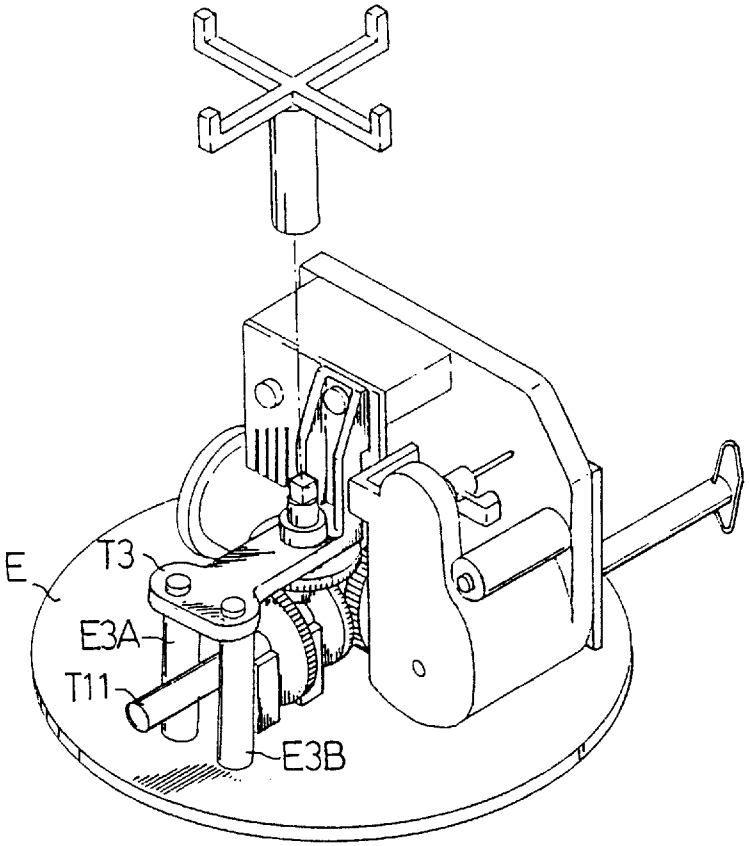
FIG. 17 shown a modified embodiment of the steering means of FIG. 15.

FIG. 17 shown a modified embodiment of said steering means (T), wherein one end of the frame (T3) is supporting by two supporting columns (E3A, E3B) the gap between which is larger than the diameter of the axle center (T11) of the gear (T1). Thus the axle (T11) is extended outward to the outside of the wood base (D) through the supporting column (E3), as shown in the imaginary line in FIG. 14, so that the doll on the end of the axle center (T11) presents a rotation phenomenon.

I claim:

1. A crystal ball with assembled motive die set, comprising:

a bottom base;

a music box supported by said bottom base;

a driving substrate base having a motive gear opening defined therein and positioned above said music box;

a motive gear located above said motive gear opening;

at least one driven gear rotatably supported by said driving substrate base and being operatively engaged with said motive gear;

a driving substrate top cover disposed above said motive gear and said driven gear and having at least one cover opening positioned in accordance with the position of said driven gear; and at least one motive die set including a motive die set body having an upper disk face, a lower neck portion and an opening defined therethrough, a rotary member and a claw member, said lower neck portion of said motive die set body being removably received in said cover opening, said rotary member being coupled with said claw member through said opening defined through said body such that said rotary member is disposed atop said upper disk face and is rotated relative to said body when said claw member is rotated relative to said body, and said claw member being engaged with said driven gear such that said claw member is rotated when said driven gear is rotated relative to said driving substrate base.

2. The crystal ball defined by claim 1, wherein:

said motive gear or said driven gear is further operatively engaged with a rotating member.

3. The crystal ball defined by claim 1, wherein:

said rotary member includes a pin member extending therefrom.

4. The crystal ball defined by claim 3, wherein:

said pin member is disposed at a location offset from the center of said rotary member.

5. The crystal ball defined by claim 4, further comprising:

a first connection link having a first end and a second end, said first end being rotatably engaged with said pin member extending from said rotary member such that said first end of said first connection link is displaced when said rotary member rotates.

6. The crystal ball defined by claim 5, further comprising:

a second connection link having a first end pivotally engaged with said second end of said first connection link.

7. The crystal ball defined by claim 4, further comprising:

a vibrating block having a pin engagement opening defined therein, and said pin extending from said rotary member being received in said pin engagement opening.

8. The crystal ball defined by claim 7, wherein:

said rotary member includes supporting walls, said vibrating block being pivotally coupled to said supporting walls.

9. The crystal ball defined by claim 8, wherein:

when said rotary member is rotated, said pin remains received in said pin engagement opening thereby causing said vibrating block to pivot in a reciprocating manner.

10. The crystal ball defined by claim 9, further comprising:

means for transmitting rotational force from said music box to said motive gear.

11. A crystal ball, comprising:

a bottom base;

a music box supported in a longitudinal orientation by said bottom base;

a driving substrate supported above said music box, said driving substrate including a driving substrate base, a plurality of gears rotatably supported by said driving substrate base and a driving substrate cover supported above said gears;

an assembled die set driven by one of said gears;

a first and a second longitudinal gear fixed on an axle rotatably supported by said bottom base, said first gear being operatively engaged with a rotating gear of said music box;

a crown gear operatively engaged with said second longitudinal gear, said crown gear being operatively coupled to one of said gears of said driving substrate; and a crown gear support rotatable supporting said crown gear, said crown gear support being fixed to said music box and said bottom base.

12. The crystal ball defined by claim 11, wherein:

said bottom base supports said axle with two columns.

* * * * *